US006935947B1

(12) United States Patent
Singer et al.

(10) Patent No.: US 6,935,947 B1
(45) Date of Patent: Aug. 30, 2005

(54) SLOT MACHINE GAME HAVING A PLURALITY OF WAYS FOR A USER TO OBTAIN PAYOUTS BASED UPON MATCHING TWO OR MORE SYMBOLS DRAWN FROM THE SYMBOL MATRIX DURING ONE OR MORE SPINS ("PAIR' EM UP")

(75) Inventors: Anthony M. Singer, Ringwood, NJ (US); Howard M. Marks, Westport, CT (US); Daniel M. Marks, Brooklyn, NY (US)

(73) Assignee: PTT, LLC, Nanuet, NY (US)

( * ) Notice: Subject to any disclaimer, the term of this patent is extended or adjusted under 35 U.S.C. 154(b) by 385 days.

(21) Appl. No.: 10/105,942

(22) Filed: Mar. 26, 2002

Related U.S. Application Data

(63) Continuation-in-part of application No. 09/432,602, filed on Nov. 3, 1999, now abandoned, which is a continuation-in-part of application No. 09/234,098, filed on Jan. 19, 1999, now Pat. No. 6,371,851, which is a continuation of application No. PCT/US98/10373, filed on May 21, 1998.

(60) Provisional application No. 60/047,493, filed on May 23, 1997, provisional application No. 60/289,633, filed on May 9, 2001.

(51) Int. Cl.[7] ..... A63F 9/24
(52) U.S. Cl. ..... 463/16; 463/20; 273/143 R
(58) Field of Search ..... 463/1, 9–13, 16–20, 463/25–30, 36, 40–43; 273/236–237, 269, 273/138.1, 138.2, 139, 143 R, 292–293; 700/91–93

(56) References Cited

U.S. PATENT DOCUMENTS 4,743,022 A 5/1988 Wood
4,948,134 A 8/1990 Suttle et al.
5,013,049 A 5/1991 Tomaszewski
5,019,973 A 5/1991 Wilcox et al.

(Continued)

FOREIGN PATENT DOCUMENTS

EP 449433 A2 * 10/1991 ..... G07F 17/34

(Continued)

OTHER PUBLICATIONS

International Search Report for Application No. PCT/US97/08152.

*Primary Examiner*—Mark Sager
(74) *Attorney, Agent, or Firm*—Irah H. Donner; Wilmer Cutler Pickering Hale and Dorr LLP

(57) ABSTRACT

A slot machine provides awards based upon matching two or more symbols drawn from the symbol matrix during one or more spins ("Pair'em Up"). In one embodiment:

The game starts with an empty Pair'em Up window.

At the end of every spin, the symbol appearing in symbol position 3/2 is duplicated into an empty section of the Pair'em Up window.

If the newest symbol in the Pair'em Up window matches any of the other symbols in the Pair'em Up window, the two matching symbol are cleared from the Pair'em Up window.

For each pair of matching symbols made during a Pair'em Up game, the player receives an escalating award based upon the Pair'em Up pay table.

If the Pair'em Up window fills with 5 unmatched symbols, the game ends.

26 Claims, 10 Drawing Sheets

U.S. PATENT DOCUMENTS 5,033,744 A 7/1991 Bridgeman et al.
5,083,271 A 1/1992 Thacher et al.
5,100,137 A 3/1992 Fulton
5,118,109 A 6/1992 Gumina
5,255,915 A 10/1993 Miller
5,294,128 A 3/1994 Marquez
5,314,194 A 5/1994 Wolf
5,382,025 A 1/1995 Sklansky et al.
5,393,057 A * 2/1995 Marnell, II ..... 463/13
5,393,067 A 2/1995 Paulsen et al.
5,401,023 A 3/1995 Wood
5,407,199 A 4/1995 Gumina
5,415,404 A 5/1995 Joshi et al.
5,429,361 A 7/1995 Raven et al.
5,431,407 A 7/1995 Hofberg et al.
5,437,451 A 8/1995 Fulton
5,488,411 A 1/1996 Lewis
5,630,753 A 5/1997 Fuchs
5,655,961 A 8/1997 Acres et al.
5,711,715 A 1/1998 Ringo et al.
5,755,621 A 5/1998 Marks et al.
5,770,533 A 6/1998 Franchi
5,788,573 A * 8/1998 Baerlocher et al. ..... 463/16
5,830,068 A 11/1998 Brenner et al.
5,882,259 A 3/1999 Holmes, Jr. et al.
6,093,100 A 7/2000 Singer et al.
6,371,851 B1 4/2002 Singer et al.

FOREIGN PATENT DOCUMENTS

GB 1359852 A * 7/1974 ..... G07F 17/34
GB 1591623 A * 6/1981 ..... G07F 17/34
WO WO 98/52659 11/1998

* cited by examiner

SLOT MACHINE GAME HAVING A PLURALITY OF WAYS FOR A USER TO OBTAIN PAYOUTS BASED UPON MATCHING TWO OR MORE SYMBOLS DRAWN FROM THE SYMBOL MATRIX DURING ONE OR MORE SPINS ("PAIR' EM UP")

CROSS-REFERENCE TO RELATED APPLICATION

This application is related to and is a continuation-in-part of U.S. application Ser. No. 09/432,602, filed on Nov. 3, 1999 now abandon, which is a continuation-in-part of U.S. application Ser. No. 09/234,098, filed Jan. 19, 1999 U.S. Pat. No. 6,371,651, which is a continuation of International Application No. PCT/US98/10373, filed on May 21, 1998, which in turn claims priority to U.S. Provisional Application Ser. No. 60/047,493, filed on May 23, 1997, entitled "Pairs Card Game and Computer Implemented Game Using Interactive Networking System For Implementing Same." This application is related to and claims priority to U.S. Provisional Application Ser. No. 60/289,633, filed on May 9, 2001, entitled "Slot-Active Bonus Pairs". All of the above applications are incorporated herein by reference in their entirety.

BACKGROUND OF THE INVENTION

1. Field of Invention

The present invention relates generally to payout methods in a mechanical, an electromechanical and/or standard computer-based slot machine-like games-of-chance and, more particularly, to a method, an apparatus, and a computer readable medium storing computer-executable instructions for providing awards based upon matching two- or more symbols drawn from the symbol matrix during one or more spins ("Pair'em Up"), as described below in detail.

2. Background Description

To play a slot machine a player deposits money in the form of coins, gaming tokens or paper currency either into a coin head or bill acceptor ("the coin-in"). The coins and gaming tokens are collected in a reservoir inside the gaming machine ("the hopper") while the paper currency is collected in the bill acceptor inside the gaming machine. If the coins, gaming tokens or paper currency are validated as authentic, the player accrues the appropriate number of playing units ("credits") on a credit meter on the gaming machine depending on the denomination of the wager as set on the gaming machine. For example, a twenty-five cent gaming machine will accrue four credits for each dollar deposited into the gaming machine by way of the coin head or the bill acceptor.

After accruing credits on the credit meter, the player determines how many credits he wishes to wager on the next spin of the slot reels ("total bet") and then spins the reels by pressing the spin button or by pulling a handle. When the reels stop spinning, symbols are displayed on the slot reels ("symbol matrix"). The player then collects credits for predetermined symbol combinations ("winning combinations"), if any, according to a pre-determined schedule ("pay table"). More specifically, the standard slot machine operates as follows:

Symbol Matrix. Slot symbols are displayed on 3 or more slot reels (also called "columns") placed adjacent to each other. Each column contains at least 3 rows, with a symbol in each row. The resulting matrix of symbols ("symbol matrix") ranges from 3 columns by 3 rows with 9 total symbols to 5 columns by 3 rows with 15 total symbols. Within the symbol matrix, positions on the slot reels may be referred to according to column, from left to right, and row, from the top to bottom ("symbol positions"). For example: symbol position 1/2 is located in column 1 (i.e., left-most column) and row 2 (i.e., middle row).

Winning Combinations. Players collect credits for predetermined winning symbol combinations that appear in specific locations ("pay lines") on the slot reels. Winning combinations typically require that three or more of the same symbols appear adjacent to each other starting from the leftmost position of a pay line ("line pays"). For example: a player may collect a line pay if 3 Banana symbols appeared in symbol positions 1/1, 2/1, 3/1 on a pay line using symbol positions 1/1, 2/1, 3/1, 4/1, and 5/1.

Alternatively, players may also collect credits for predetermined winning combinations that appear anywhere on a pay line ("line scatter pays") or anywhere on the slot reels ("reel scatter pays"). For example, a player may collect a line scatter pay if 3 Banana symbols appeared in symbol positions 1/1, 3/1, 5/1 on a pay line using symbol positions 1/1, 2/1, 3/1, 4/1, and 5/1; and collect a reel scatter pay if 3 Banana symbols appeared anywhere on the slot reels.

Pay Table. Credits are awarded to the player for each winning symbol combination based on a predetermined schedule ("pay table"). For line pays and line scatter pays, the number of credits wagered on the winning pay line multiplies the number of credits indicated by the pay table. For example, a player may wager two credits each on five pay lines, spin the reels, and collect twice the amount indicated on the pay table for a line pay or line scatter pay appearing on any of the five played pay lines. For reel scatter pays, the total number of credits wagered multiplies the number of credits indicated by the pay table. For example, a player may wager ten total credits, spin the reels, and collect twice the amount indicated on the pay table for a reel scatter pay appearing on anywhere on the slot reels.

Following any type of pay (e.g., line pays, line scatter pays and reel scatter pays), the credits won are added to the player's balance of credits shown in the credit meter. As long as the player has credits on the credit meter, the player may continue to play the gaming machine. In addition, the player may also: collect the remaining balance of credits by pressing a Cash Out button the gaming machine; view the rules of the game by pressing the Help button before any spin; and/or view the game's pay table by pressing the Pays button before any spin.

Conventional slot machines only issues awards for the types of winning combinations described above. As a result of this limitation:

Players suffer from the boredom of playing "new" games with different graphics that really use the same "old" awards;

Casinos suffer from the players' dissatisfaction with the casino's game selection as they cannot distinguish their game offerings from other casinos; and Game manufacturers suffer declining orders as they cannot distinguish their product line from the other manufacturers.

SUMMARY OF THE INVENTION

It is an object of the present invention to address the limitations associated with conventional slot machines by creating additional and/or enhanced awards.

It is one feature and advantage of the present invention to provide a game that awards a player based upon, for example, matching two or more symbols drawn from the symbol matrix during one or more spins ("Pair'em Up"). The Pair'em Up concept creates a slot game with a wider variety of awards which benefits all parties: the game manufacturer adds a unique product to their sales line; the casino attracts and retains players interested in playing an innovative slot game; and the player enjoys a new method of receiving an award. Other objects, features and advantages of the present invention are described below.

The present invention includes a variety of methods of play that can be programmed on an electronic video slot machine to enable matching of two or more symbols drawn from the symbol matrix during one or more spins ("Pair'em Up").

In a preferred embodiment of the present invention, Pair'em Up issues awards for matching two of the same symbols, as follows:

Pair'em Up window—

One window divided into 5 sections; and

Displayed above the symbol matrix.

Pair'em Up pay table—

Award schedule for each pair made during the Pair'em Up game, as follows.

| | |
|---|---|
| Pair 1 | 1 |
| Pair 2 | 2 |
| Pair 3 | 5 |
| Pair 4 | 15 |
| Pair 5 | 50 |
| Pair 6 | 100 |
| Pair 7 | 250 |
| Pair 8 | 500 |
| Pair 9 | 1,000 |
| Pair 10 | 10,000 |
| Pair 11 | 100,000 |
| Pair 12 | 1,000,000 |

Pair'em Up symbol position—

Symbol position 3/2 in the symbol matrix is "boxed" by permanently placing a black box around the symbol position.

Pair'em Up game—

The game starts with an empty Pair'em Up window.

At the end of every spin, the symbol appearing in symbol position 3/2 is duplicated into an empty section of the Pair'em Up window.

If the newest symbol in the Pair'em Up window matches any of the other symbols in the Pair'em Up window, the two matching symbols are cleared from the Pair'em Up window.

For each pair of matching symbols made during a Pair'em Up game, the player receives an escalating award based upon the Pair'em Up pay table.

If the Pair'em Up window fills with 5 unmatched symbols, the game ends, the player is paid any Pair'em Up awards, and the Pair'em Up window is cleared.

The player may continue to play any number of Pair'em Up games; or a player may leave in the middle of a Pair'em Up game, and optionally allow the next player to utilize any symbols left in the Pair'em Up window.

The preferred embodiment of the present invention, therefore, offers a "matching" award that operates independently of line pays or scatter pays and, therefore, offers an additional opportunity to reward the player.

Alternatively, the present invention allows for many alternative embodiments, including but not limited to the following:

Pair'Em up Window—

Any number of symbols in the Pair'em Up window. The present invention allows for any number of symbols to be displayed in the Pair'em Up window. For example, the Pair'em Up window may display ten symbols.

Any location of the Pair'em Up window. The present invention allows for locating the Pair'em Up window anywhere on the game's main screen, second-screen, and/or a separate display device. For example, the Pair'em Up window may be located on a separate, secondary display screen position above the primary display screen.

Symbol Selection:

Any method of symbol selection. The present invention allows for any method of selecting a symbol from the symbol matrix. For example, symbols may be selected from one or more fixed positions; predetermined positions; positions selected by the player or third party; and/or selected from random positions. In addition, the method of selecting symbols may change based on player input, third party input, the number of spins, pre-determined symbol combinations, wager level, and/or at random.

Any type of symbol selected. The present invention allows for the selection of any type of symbol. For example, the game may select any symbol, a sub-set of symbols, a specific symbol, and/or random symbol types. In addition, the types of symbols selected may change based on player input, third party input, the number of spins, pre-determined symbol combinations, wager level, and/or at random.

Any number of symbols selected. The present invention allows for selection of any number of symbols from the symbol matrix. For example, the game may select a fixed number of symbols each spin or a changing number of symbols from spin to spin, with the number of symbols selected optionally dependent on the player or third party input, pre-determined symbol combinations, wager level, and/or at random.

Any effect of selection upon symbols. The present invention allows for any effect of selecting a symbol from the symbol matrix. For example, the selected symbols may be kept on the symbol matrix and copied into the Pair'em Up window; or, symbols may be removed from the matrix and placed in the Pair'em Up window.

Symbol Matching:

Any type of match. The present invention allows for any type of matching symbols in the Pair'em Up window. For example, a "match" may require two or more of the same symbols, a set of any three pre-determined symbols, a specific symbol with any other predetermined symbol, a member of one symbol sub-set with a member of another symbol sub-set, and/or any other predetermined combination of two or more symbols. In addition, the type of matching symbols may change from spin-to-spin optionally based on player or third party input, pre-determined symbol combinations, wager level, and/or at random.

Any number of matching symbols. The present invention allows for any number of symbols to form a match. For example, a match may require at least 2 symbols, an exact number of symbols, and/or a maximum of a number of symbols. In addition, the number of symbols required to make a match may change from spin-to-spin optionally based on player or third party input, pre-determined symbol combinations, wager level, and/or at random.

Game Play:

Any method of beginning/ending a game. The present invention allows for a game to begin and/or end at any point in time. For example, a new game may begin if any one or more of: the player inserts coins; the player presses the New Game button; the Pair'em Up window is filled; the Pair'em Up window is emptied; one or more special symbols appear in the symbol matrix; one or more special symbols appear in the Pair'em Up window; after a pre-determined number of spins; after a random number of spins; after a number of spins determined by the overall wager level or separate wager placed on the Pair'em Up game; and/or at random.

And a game may end whenever any one or more of: the player runs out of credits; the player presses the End Game button; the Pair'em Up window is filled; the Pair'em Up window is emptied; one or more special symbols appear in the symbol matrix; one or more special symbols appear in the Pair'em Up window; after a pre-determined number of spins; after a random number of spins; after a number of spins determined by the overall wager level or separate wager placed on the Pair'em Up game; and/or at random.

Any method of displaying matching symbols. The present invention allows for any method of displaying matching symbols. For example, the matching symbols may be removed from the Pair'em Up window and displayed in one or more columns, with the value of each matching set listed next to the set; or, the matching sets may simply be removed from the Pair'em up window and only the cumulative value of the matching sets displayed.

Alternatively, matching sets may remain in the Pair'em up window. Matching sets may remain for any reason, such as forming larger matching sets at the discretion of the player and/or according to a strategic algorithm. Matching sets in Pair'em Up window may be cashed-in by the player at the time of formation and/or at any subsequent time during the game.

Game Awards:

Any number of matches. The present invention allows for awarding any number of matches. For example, the game may allow an infinite number of matches, limit matches to a fixed number, limit matches to a variable number dependent on wager level, bet per pay line, pay lines selected, actions the player and/or third party, and/or limit matches at random. In addition, the number of matches may also be limited by type of symbol or type of match. For example, the game may optionally allow an infinite number of same 2-symbol pairs, a total of 20 pairs using a Wild symbol, and 1 three-of-a-kind match per 5 credits wagered.

Any award schedule. The present invention allows for issuing awards for a single match and/or group of matches. For example, the game may start awarding credits after the third match, proceed to issue awards for each of the next 20 matches and then issue awards for every 5 subsequent matches. In addition, the game may issue any amount of award for each match or group of matches. For example, the first match may result in a 2 credit award, the second match may be 3 times the bet per line, the third award may be 5 times the total bet, the fourth award may be 10 times the wager made on the Pair'em Up game, the fifth award may 2 times the cumulative amount of credits already won in the Pair'em Up game, the sixth award may be 25 times the number of pairs already formed, and/or the seventh award may be 100 times the number of three-of-a-kind matches already formed.

Any type of award. The present invention allows for the issuance of any type(s) of award. For example, the first award issued may be credits, the second award may be free spins, and all subsequent awards may alternate between these two types of awards. In addition, the type of award may depend on the type of symbol or match. For example, all matches using Wild symbols may award free spins and all other matches award credits. Alternatively, bonus rewards or other awards may be awarded.

Any type of game. The present invention allows for implementation on any type of game, with any number of reels, symbol strips and/or symbol sets. For example, Pair'em Up may be implemented on a standard 3-reel mechanical slot machine, a 5-reel mechanical slot machine, and/or a video slot machine with 3 reels. Alternatively, the present invention may apply to standard video poker and/or standard video card games where one or more of rank and/or suit may be used for matching and/or predetermined combinations.

All of these alternative embodiments rely upon the underlying Pair'em Up concept to issues awards based upon matching two or more symbols drawn from the symbol matrix during one or more spins.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other systems and methods for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The Detailed Description including the description of a preferred structure as embodying features of the invention will be best understood when read in reference to the accompanying figures wherein.

NOTATIONS AND NOMENCLATURE

Figure 1:
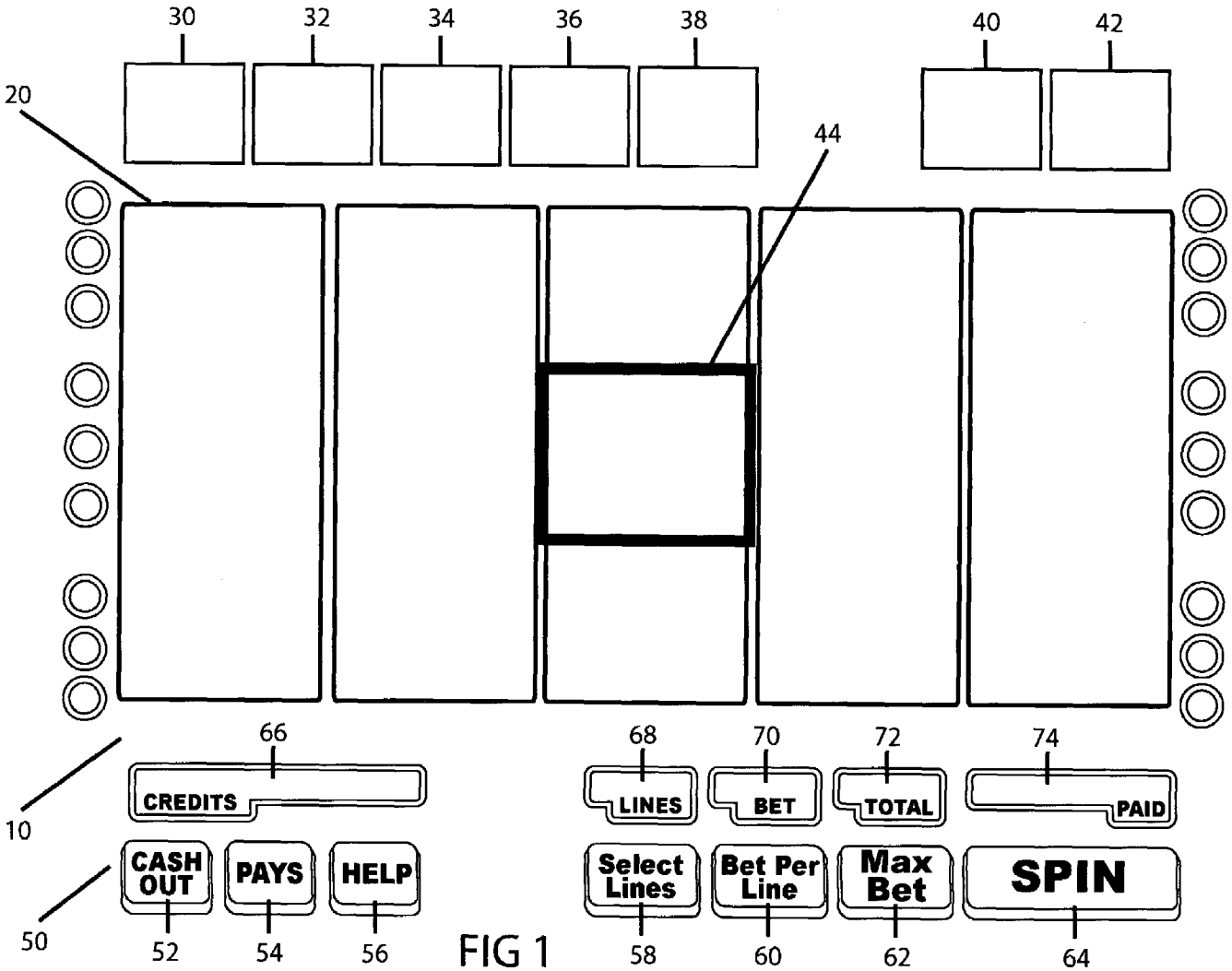
FIG. 1 shows an illustrative example of representative displays that may be encountered during a typical game in accordance with the principles of the present invention.

The detailed descriptions which follow may be presented in terms of program procedures executed on a computer or network of computers. These procedural descriptions and representations are the means used by those skilled in the art to most effectively convey the substance of their work to others skilled in the art.

A procedure is here, and generally, conceived to be a self-consistent sequence of steps leading to a desired result. These steps are those requiring physical manipulations of physical quantities. Usually, though not necessarily, these quantities take the form of electrical or magnetic signals capable of being stored, transferred, combined, compared and otherwise manipulated. It proves convenient at times, principally for reasons of common usage, to refer to these signals as bits, values, elements, symbols, characters, terms, numbers, or the like. It should be noted, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary, or desirable in most cases, in any of the operations described herein which form part of the present invention; the operations are machine and/or manual operations. Useful machines for performing the operation of the present invention include general purpose digital computers or similar devices.

The present invention also relates to apparatus for performing these operations. This apparatus may be specially constructed for the required purpose or it may comprise a general purpose computer as selectively activated or reconfigured by a computer program stored in the computer. The procedures presented herein are not inherently related to a particular computer or other apparatus. Various general purpose machines may be used with programs written in accordance with the teachings herein, or it may prove more convenient to construct more specialized apparatus to perform the required method steps. The required structure for a variety of these machines will appear from the description given.

DETAILED DESCRIPTION OF A PREFERRED EMBODIMENT OF THE INVENTION

Reference now will be made in detail to the presently preferred embodiments of the invention. Such embodiments are provided by way of explanation of the invention, which is not intended to be limited thereto. In fact, those of ordinary skill in the art may appreciate upon reading the present specification and viewing the present drawings that various modifications and variations can be made.

For example, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

The preferred embodiment of the present invention includes the play of the base game and Pair'em Up bonus game, as described below:

Base Game. To play the base game, the player optionally establishes a pool of credits, optionally selects pay lines, optionally sets the wager per pay line, spins the reels, selects the Pair'em Up symbol, collects credits for winning symbol combinations and/or collects credits for Pair'em Up matches. In an alternative embodiment, now wagering or input fee is required to play the game.

Video Display. In a preferred embodiment of the present invention, the slot game is played on a video display screen, as generally shown at 10 in FIGS. 1–7. The displays screen shows:

- A symbol matrix with fifteen symbol positions using a five-column by three-row arrangement, as shown generally at 20 in FIGS. 1–7;
- A Pair'em Up window with five symbol positions, as shown generally at 30–38 in FIGS. 1–7;
- A Button Panel 50 that holds the buttons 52–64 used to control the game; and
- Meters 66–74 that display the relevant game information to the player.

Buttons. In the preferred embodiment of the present invention, a set of buttons are mounted on the button panel 50 and are used by the player to control the functions of the slot game. These buttons include Select Pay Lines 58, Bet Per Line 60, Max Bet 62, Spin Reels 64, Pay Table 54, Help 56, and Cash Out 52. Any or all of these control buttons 52–64 may be displayed on the video display and/or buttons hard wired to the gaming device. If necessary, any number of buttons may be added to further facilitate control of the games. Alternatively, touch screen areas, switches or other functionality may be provided for player selection, and any combination of the above selections may be used.

Meters. In the preferred embodiment of the present invention, a set of meters 66–74 are shown on the video display screen to display the salient information for the game, including, for example, Number of Pay Lines 68, Amount Bet Per Line 70, Total Bet 72, Paid 74 and Credits 66:

The Number of Pay Lines meter 68 is associated with the Select Pay Lines button 58 and displays the current number of Pay Lines Selected;

The Amount Bet Per Line meter 70 is associated with the Bet Per Line button 60 and displays the number of credits wagered per pay line;

The Total Bet meter 72 displays the cumulative value of the Number of Pay Lines and Amount Bet Per Line;

The Paid meter 74 displays the number of credits won on the last spin; and

The Credits meter 66 which displays the total number of credits remaining in the credit pool.

In addition, the game also uses a Number of Pairs meter 40 that displays the number of matches formed in the Pair'em Up game; and a Pairs Credits meter 42 that displays the cumulative number of credits won for the Pair'em Up game. Alternatively, different combinations of the above referenced meters may be used, depending on the specific information that is to be conveyed to the player.

Credit Pool. In a preferred embodiment of the present invention, the player deposits coins, tokens or paper currency into the coin head slot or a paper currency bill acceptor to establish a credit pool. The amount of the pool of credits is displayed to the player on the Credits meter 66. The pool of credits increases and decreases according to the player's wins or losses and may be supplemented, if necessary, by the player by additional deposits of coins, tokens or paper currency.

Select Pay Lines. In a preferred embodiment of the present invention, the slot game has a plurality of pay lines upon which to wager. The pay lines wagered on by the player activate in a predetermined order. For example, the slot game may utilize nine pay lines of which the player's first wager is applied to pay line 1, the second wager is applied to pay line 2, the third wager is applied to pay line 3, and so on up until the ninth wager is applied to pay line 9. However, the games may utilize any other order of pay line activation and fewer or greater than nine pay lines may be used. Alternatively, pay lines do not have to be used at all.

Bet Per Line. In a preferred embodiment of the present invention, the player sets the value of the wager on each pay line; the same amount is wagered on each pay line. Alternatively, the player could be allowed to make wagers of different amounts on each pay line. The total amount wagered is determined by summing the amounts wagered on each pay line. Alternatively, no wager is required.

Spin Reels. In a preferred embodiment of the present invention, the player then causes the slot machine to operate by effecting a "spin" of the reels. This can be done in any suitable manner, such as the player pressing the Spin button 64 on the machine's button panel 50 and watching a video simulation of a reel slot machine.

Symbol Set. In a preferred embodiment of the present invention, the symbol set includes fifteen symbols. For each spin, the machine randomly displays three symbols from the symbol set on each reel. A common theme can be used for the symbols, and in one embodiment, the symbols are related to jewels. However, any suitable symbol may be used, including the traditional fruit symbols that commonly appear on other slot machines. Furthermore, fewer or greater than fifteen symbols may be used as a symbol set.

Select Pair'em Up Symbol. In a preferred embodiment of the present invention, the game copies the symbol displayed at Symbol Position 3/2 and highlighted by a black box 44 into the Pair'em Up windows 30–38. The symbol itself is not removed from the symbol matrix and may help form winning symbol combinations. The selected symbol, however, neither changes character (i.e. wild) to help form a winning combination nor value (i.e. multiplier) to increase the payout of a winning combination. In alternative embodiments, the symbol may be removed, change character, change multiplier, and the like.

Winning Symbol Combinations. In a preferred embodiment of the present invention, the player is paid for line pays, scatter pays, and wild symbols as follows:

Line Pays—A line pay awards the player for a winning combination of line pay symbols that appears on an active pay line. Each winning combination may involve three or more of the same symbols that appear adjacent to each other, for example, reading from the leftmost position of a pay line to the rightmost position. Alternative winning combinations may be used. Each winning combination pays the amount indicated on the game's pay table times the amount wagered on that pay line. Alternatively, any desired group of symbols may be designated as winning symbol combinations; and fewer or greater than three symbols could be designated as winning symbol combinations.

In the preferred embodiment of the present invention, the game offers the following payouts for line pay symbols 1 to 12:

| | | | | | |
|---|---|---|---|---|---|
| 12-12-12-12-12 | 5000 | 12-12-12-12 | 500 | 12-12-12 | 50 |
| 11-11-11-11-11 | 2000 | 11-11-11-11 | 250 | 11-11-11 | 50 |
| 10-10-10-10-10 | 400 | 10-10-10-10 | 150 | 10-10-10 | 25 |
| 9-9-9-9-9 | 300 | 9-9-9-9 | 150 | 9-9-9 | 25 |
| 8-8-8-8-8 | 200 | 8-8-8-8 | 100 | 8-8-8 | 20 |
| 7-7-7-7-7 | 150 | 7-7-7-7 | 100 | 7-7-7 | 20 |
| 6-6-6-6-6 | 100 | 6-6-6-6 | 50 | 6-6-6 | 15 |
| 5-5-5-5-5 | 100 | 5-5-5-5 | 50 | 5-5-5 | 15 |
| 4-4-4-4-4 | 30 | 4-4-4-4 | 20 | 4-4-4 | 10 |
| 3-3-3-3-3 | 30 | 3-3-3-3 | 20 | 3-3-3 | 10 |
| 2-2-2-2-2 | 15 | 2-2-2-2 | 10 | 2-2-2 | 5 |
| 1-1-1-1-1 | 15 | 1-1-1-1 | 10 | 1-1-1 | 5 |

Scatter Pays—A scatter pay awards the player for the appearance of a scatter symbol, or combination of scatter symbols, anywhere on a pay line ("line scatter pays") or anywhere on the slot reels ("reel scatter pays"). Unlike line pays, scatter symbols do not need to be located in adjacent positions on a pay line. Each scatter pay awards the amount indicated on the game's pay table times the amount wagered on that pay line ("line scatter pay") or the entire game ("reel scatter pay"). Scatter pays may award a specific number of credits and/or trigger a bonus feature, such as entertaining animations and/or free spins.

In the preferred embodiment of the present invention, the game offers the following payouts for scatter symbols "13" and "14":

2 or more 13 symbols trigger a first predetermined bonus.

3 or more 14 symbols trigger a second predetermined bonus.

Wild Symbols—Wild symbols replace any or all other symbols in determining winning outcomes. Alternatively, wild symbols may only replace limited subsets of the other symbols and/or multiply, enhance or even decrease the value of winning combinations formed using the Wild symbol. Wild symbols, therefore, increase (and possibly) the possibility and/or values of winning combinations and the pay table must reflect that the wild symbols are in use.

In a preferred embodiment of the present invention, the game offers the following features for wild symbol 15:

Symbol 15 replaces all line pay symbols 1 to 12 except scatter symbols 13 and 14; and Symbol 15 does not increase the value of winning line pay combinations formed using the wild symbol;

Symbol 15 does not form its own line pay combination (i.e. 15—15—15).

Note that there are zero Wild symbols on the third reel and, therefore, no Wild symbols are selected for use in the Pair'em Up game. Alternatively, Wild symbols may be used in the Pair'em Up game and replace any other symbol, a sub-set of symbols, a random symbol, and/or act as a match by itself.

Pair'em Up Matches. In a preferred embodiment of the present invention, the player makes matches, collects awards and/or cashes out of the Pair'em Up game, as follows:

Selecting Symbols—With each spin the symbol displayed at symbol position 3/2 and highlighted by a black box 44 is copied in the Pair'em Up windows 30–38. Only one symbol is copied into each window 30–38. The symbol is placed into the first empty box from left to right in the Pair'em Up windows 30–28. Alternatively, a player may select the specific symbol to place into the first empty box from left to right.

Making Matches—Each match requires any two same symbols displayed in the Pair'em Up windows 30–38. Upon matching, the matching symbols are removed from the Pair'em Up windows 30–38. In addition, each match increases the Number of Pairs meter 40 by one and increases the Pairs Credits meter 42 by the number of credits indicated in the Pair'em Up pay table.

Collecting Pairs Bonus Awards—The player receives bonus credits for every pair made until the Pair'em Up windows 30–38 fill up without any matching symbols or the player forms 12 matches. Upon ending the game, the player receives the cumulative number of credits won during the Pair'em Up game, as shown on the Pairs Credits meter 42.

The game pays for each of the 12 matches formed during the Pair'em Up game, for example, as follows:

| | |
|---|---|
| Pair 1 | 1 |
| Pair 2 | 2 |
| Pair 3 | 5 |
| Pair 4 | 15 |
| Pair 5 | 50 |
| Pair 6 | 100 |
| Pair 7 | 250 |
| Pair 8 | 500 |
| Pair 9 | 1,000 |
| Pair 10 | 10,000 |
| Pair 11 | 100,000 |
| Pair 12 | 1,000,000 |

Cashing Out—At the end of the Pair'em Up game, the player receives the cumulative number of credits displayed on the Pairs Credits meter 42. All credits received from the Pairs game are added to the base game's Credits meter and may be used to play the base game.

In the event that the player cannot continue to play the base game (i.e. no more credits in the credit pool), the player may press the cash out button 52 to receive the cumulative number of credits displayed on the Pairs Credits meter 42. Cashing out the Pairs Credits meter 42 clears the Pair'em Up windows 30–38 and resets the Number of Pairs 40 and Pairs Credits meters 42 to zero. All credits cashed out of the Pairs game are added to the base game's Credits meter 66 and may be used to play the base game. Alternative methods of crediting the player may optionally be used.

Base Game Example. Sam Slotsky is standing in front of a nickel-denomination version of the preferred embodiment of the present invention. Sam sees a 15-position symbol matrix (5-columns by 3-rows) 20 in the center of the video display 10, with 5 empty Pair'em Up windows 30–38 at the top of the display 10.

The display 10 also shows seven meters: Number of Pay Lines 68, Amount Bet Per Line 70, Total Bet 72, Paid 74, Credits 66, Number of Pairs 40 and Pairs Credits 42. And, the display also shows a button panel with seven buttons: Select Pay Lines 58, Bet Per Line 60, Bet Max 62, Spin Reels 64, Pay Table 54, Help 56 and Cash Out 52.

Sam presses the Pay Table button 54 to view the pays for winning line pays, scatter pays and the Pair'em Up game. Sam then presses the Help button 56 to view the instructions on how to play the base game and the Pair'em Up game. [Refer above for pay table and descriptions of game play.]

Figure 2:
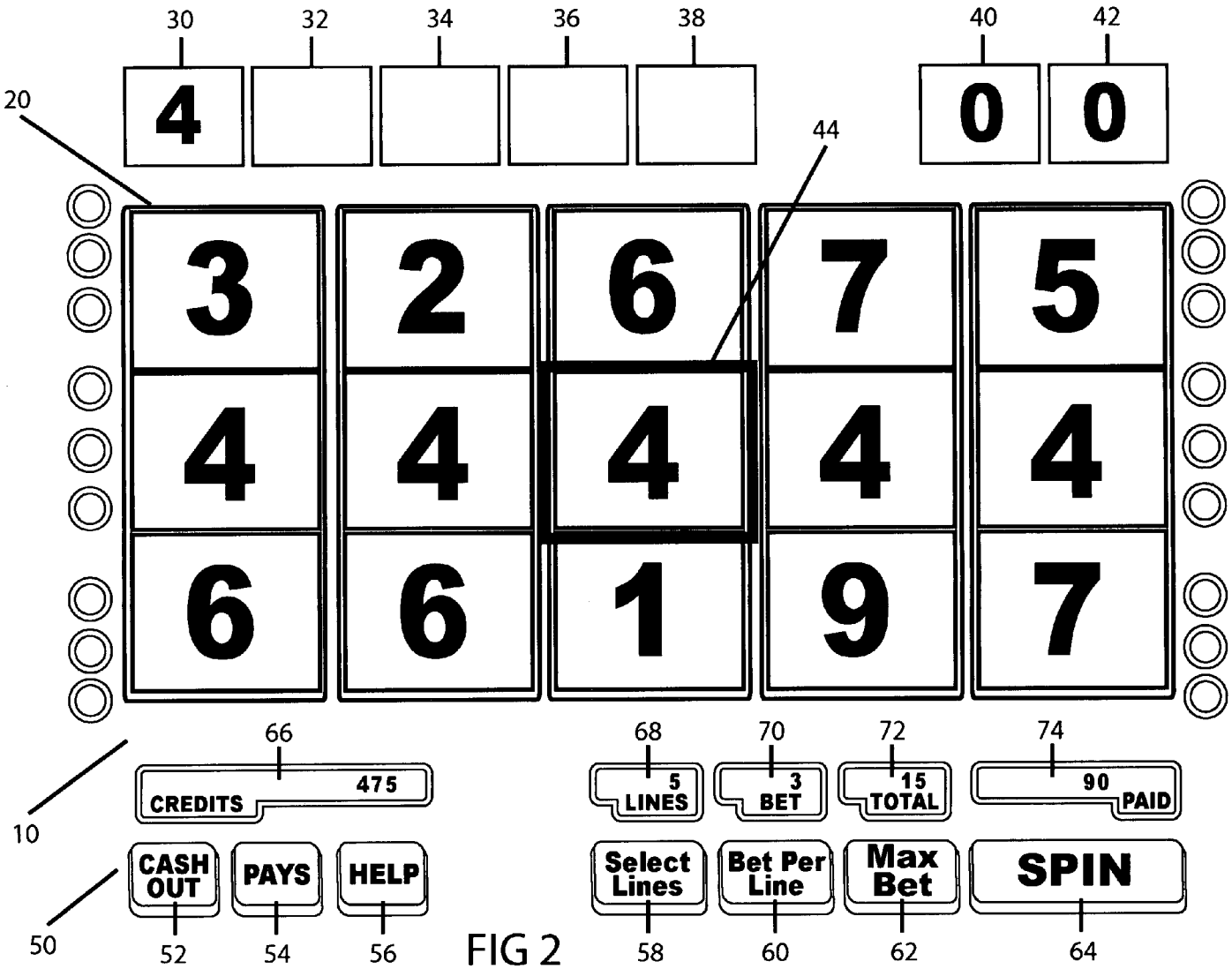
FIG. 2 shows an illustrative example of representative displays that may be encountered during a typical game in accordance with the principles of the present invention.

Sam deposits $20 into the bill receptor and the Credits meter 66 counts up from 0 to 400, as shown in FIG. 2. Sam then his chooses the wager for the game:

The game's Number of Pay Lines meter reads 1. Sam presses the Select Pay Lines button 58 four times and the Number of Pay Lines meter 68 counts up from 1 to 5. As Sam presses the Select Pay Lines button 58, the video display shows the locations of each selected pay line on the five-column by three-row matrix. For example, the first pay line starts in the middle row of the first column and proceeds in the straight line through the middle row of columns 2 through 5;

The game's Amount Bet Per Line meter reads 1. Sam presses the Bet Per Line button 60 two times and the Amount Bet Per Line meter 70 counts up from 1 to 3;

The Total Bet meter 72 started at 1, but after Sam's adjustments it now reads 15;

The Paid meter 74 reads 0;

The Number of Pairs meter 40 reads 0; and

The Pairs Credits meter 42 reads 0.

After setting his wager, Sam presses the Spin Reels button 64. The Credits meter 66 counts down from 400 to 385. The slot reels spin and then stop. Using the numbers 1 to 15 to represent the symbol set, with 13 and 14 as the scatter symbols, and 15 as the wild symbol, the reels of the game display the following symbols, as shown in FIG. 2:

| | | | | |
|---|---|---|---|---|
| 3 | 2 | 6 | 7 | 5 |
| **4** | **4** | **[4]** | **4** | **4** |
| 6 | 6 | 1 | 9 | 7 |

(Selected Symbol indicated by [brackets].)
(Winning symbol combination in bold.)

The base game awards Sam 90 credits for a winning symbol combination of 4—4—4—4—4 on pay line 1. The award reflects the game pay table which states that 4—4—4—4—4 pays 30 credits for each credit wagered upon the pay line; or 30 credits times 3 credits wagered by Sam on pay line 1. Note that the Selected Symbol was used to form the winning combination. The Credits meter 66 counts up from 385 to 475 and the game Paid meter 74 reads 90.

In addition, the selected symbol "4" is copied from the symbol matrix position 3/2 (highlighted by a black box) 44 into the first Pair'em Up window 30. The Pair'em Up windows 30–38 contain one symbol: 4. Since there is no match yet available on the first spin, the Pair'em Up game does not award any credits. The Credits meter 66 stays at 475 and the Paid meter 74 stays 90.

Figure 3:
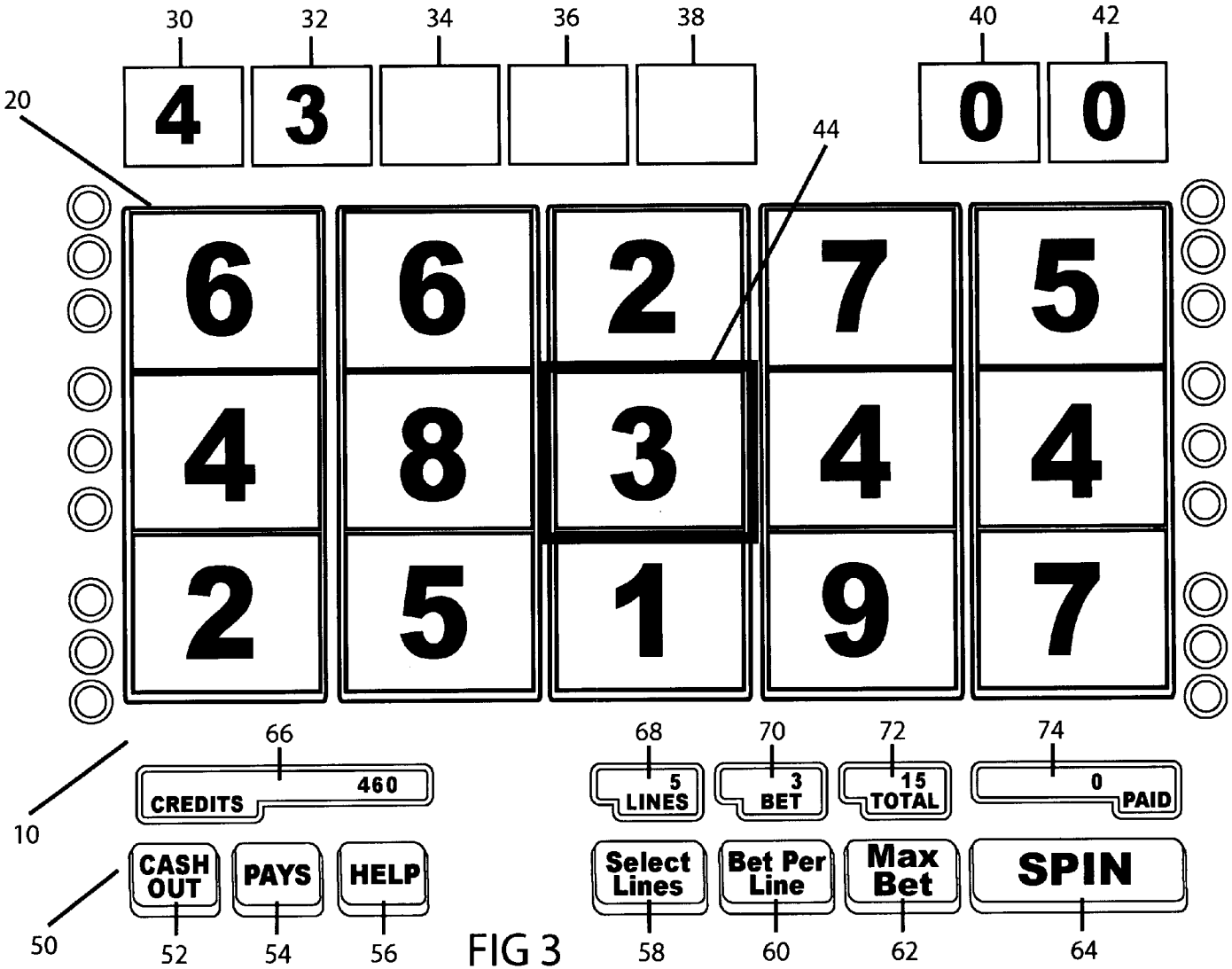
FIG. 3 shows an illustrative example of representative displays that may be encountered during a typical game in accordance with the principles of the present invention.

Again, Sam presses the Spin Reels button 64. The Credits meter 66 counts down from 475 to 460. The slot reels spin and stop. Using the numbers 1 to 15 to represent the symbol set, with 13 and 14 as the scatter symbols, and 15 as the wild symbol, the reels of the game display the following symbols, as shown in FIG. 3:

| | | | | |
|---|---|---|---|---|
| 6 | 6 | 2 | 7 | 5 |
| 4 | 8 | [3] | 4 | 4 |
| 2 | 5 | 1 | 9 | 7 |

(Selected Symbol indicated by [brackets].)

Since there is no winning line pay, the base game does not award any credits. The selected symbol "3" is copied from the symbol matrix position 3/2 (highlighted by a black box) 44 into the second Pair'em Up window 32. The Pair'em Up windows 30–38 contain two symbols: 4-3. Since there is no match, the Pair'em Up game does not award any credits. The Credits meter 66 stays at 460 and the Paid meter 74 reads 0.

Figure 4A:
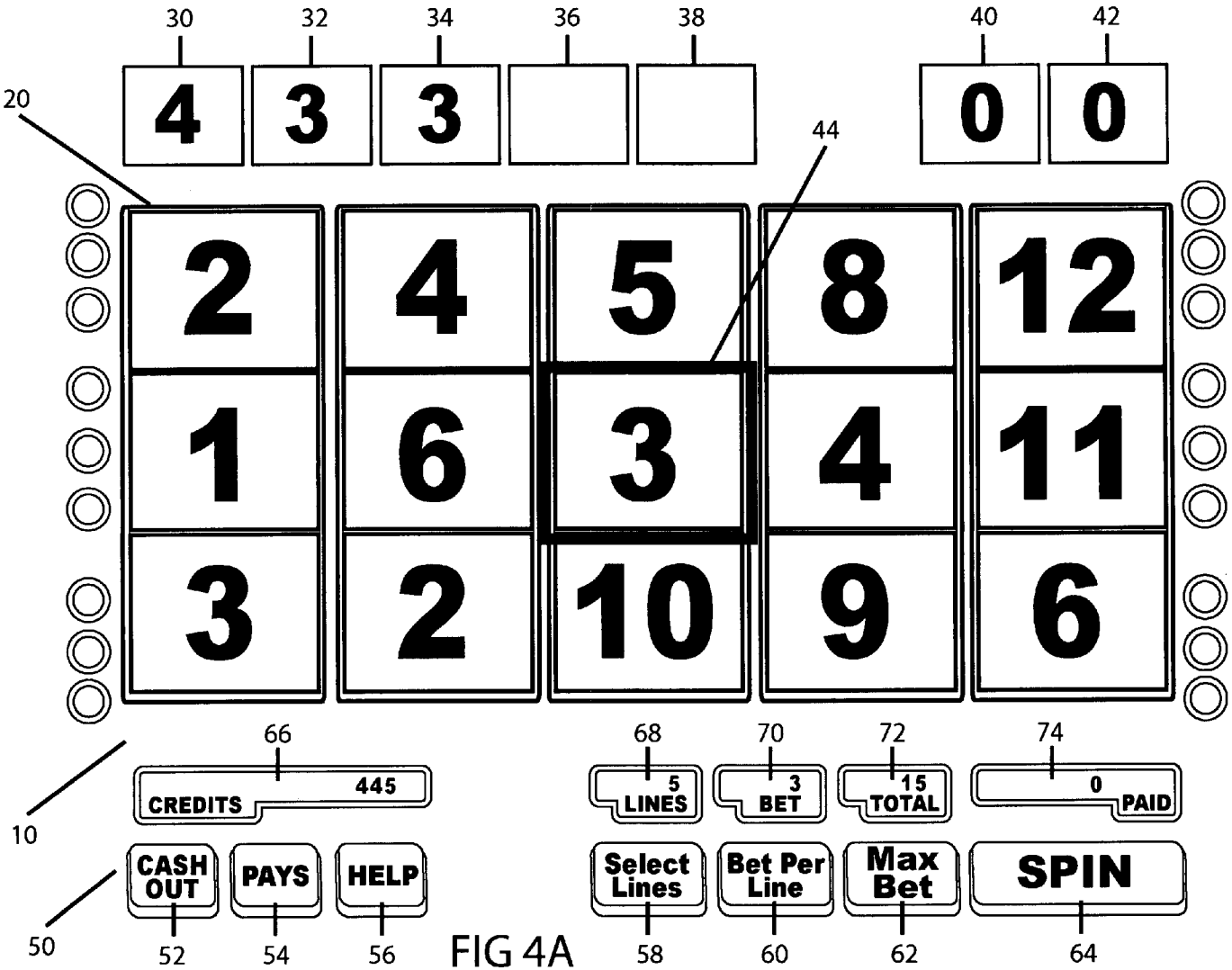
FIGS. 4*a–b* show an illustrative example of representative displays that may be encountered during a typical game in accordance with the principles of the present invention.
Figure 4B:
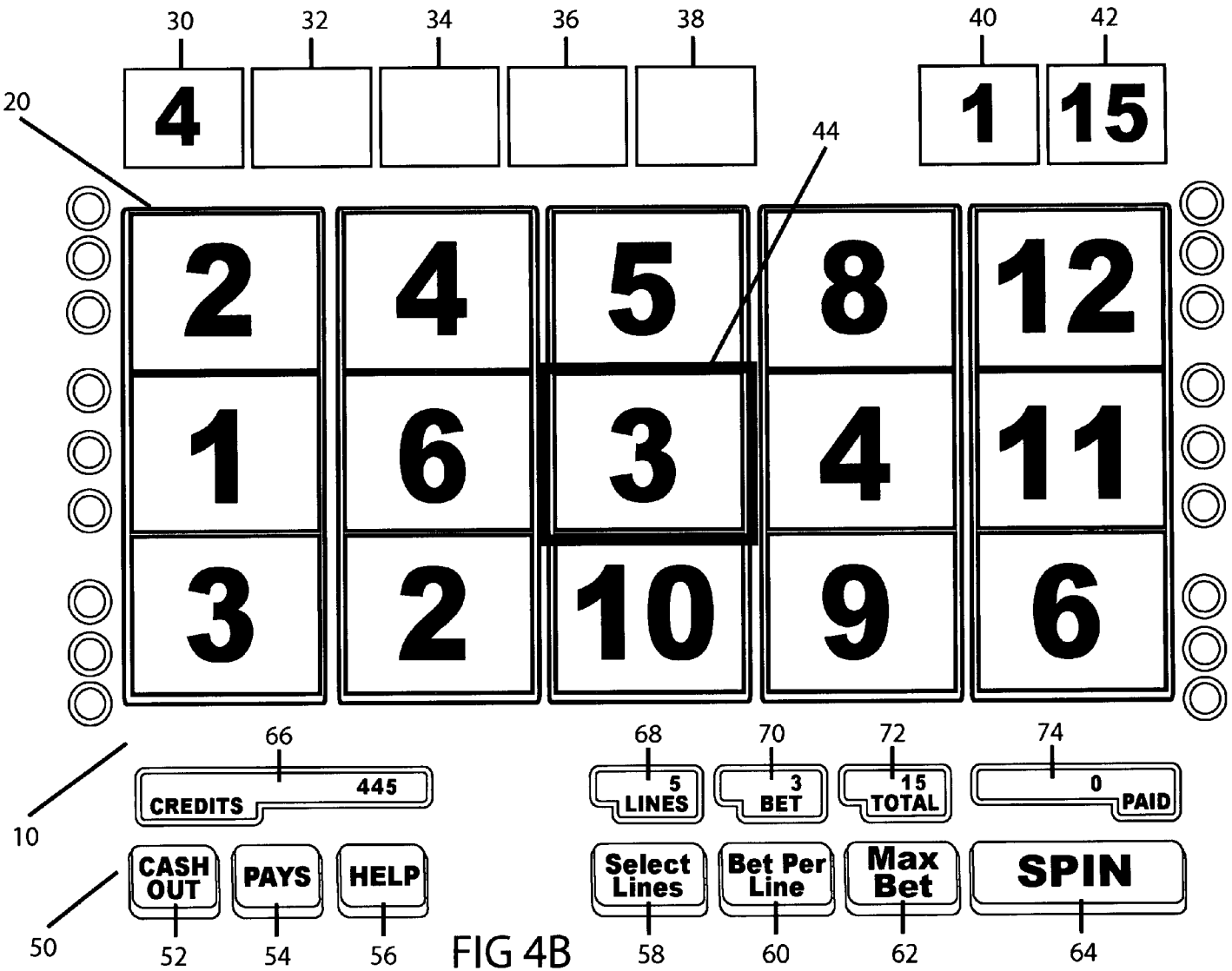

Again, Sam presses the Spin Reels button 64. The Credits meter 66 counts down from 460 to 445. The slot reels spin and stop. Using the numbers 1 to 15 to represent the symbol set, with 13 and 14 as the scatter symbols, and 15 as the wild symbol, the reels of the game display the following symbols, as shown in FIG. 4*a*:

| | | | | |
|---|---|---|---|---|
| 2 | 4 | 5 | 8 | 12 |
| 1 | 6 | [3] | 4 | 11 |
| 3 | 2 | 10 | 9 | 6 |

(Selected Symbol indicated by [brackets].)

Since there is no winning line pay, the base game does not award any credits. The selected symbol "3" is copied from the symbol matrix position 3/2 (highlighted by a black box) 44 into the third Pair'em Up window 34. The Pair'em Up windows 30–38 contain three symbols: 4–3—3. As show in FIG. 4*b*, the two 3's form a match and the 3's disappear from the Pair'em Up windows 32 and 34. And, the Pair'em Up windows 30–28 then contain one symbol: 4.

For the first match of the Pair'em Up game, the game awards 1 credit for every credit wagered, or 15 credits. The Number of Pairs meter 40 increases from 0 to 1 and the Pair Credits meter 42 increases from 0 to 15. Note that in this embodiment, the Credits meter 66 stays at 445 and the Paid meter 74 reads 0.

Figure 5:
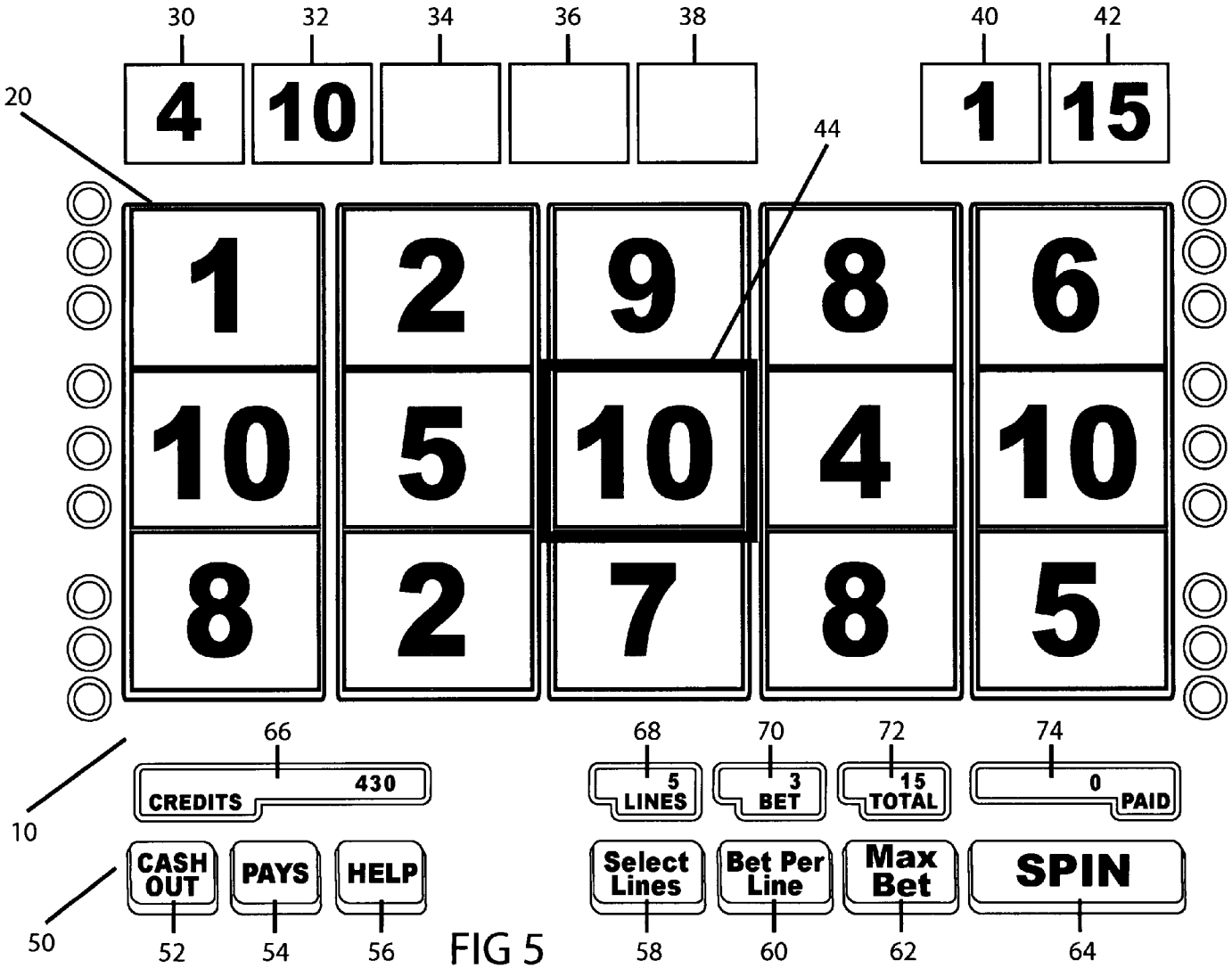
FIG. 5 shows an illustrative example of representative displays that may be encountered during a typical game in accordance with the principles of the present invention.

Again, Sam presses the Spin Reels button 64. The Credits meter 66 counts down from 445 to 430. The slot reels spin and stop. Using the numbers 1 to 15 to represent the symbol set, with 13 and 14 as the scatter symbols, and 15 as the wild symbol, the reels of the game display the following symbols, as shown in FIG. 5:

| | | | | |
|---|---|---|---|---|
| 1 | 2 | 9 | 8 | 6 |
| 10 | 5 | [10] | 4 | 10 |
| 8 | 2 | 7 | 8 | 5 |

(Selected Symbol indicated by [brackets].)

Since there is no winning line pay, the base game does not award any credits. The selected symbol "10" is copied from the symbol matrix position 3/2 (highlighted by a black box) 44 into the second Pair'em Up window 32. The Pair'em Up windows 30–38 contain two symbols: 4-10. Since there is no match, the Pair'em Up game does not award any credits. The Credits meter 66 stays at 430 and the Paid meter 74 reads 0.

Figure 6A:
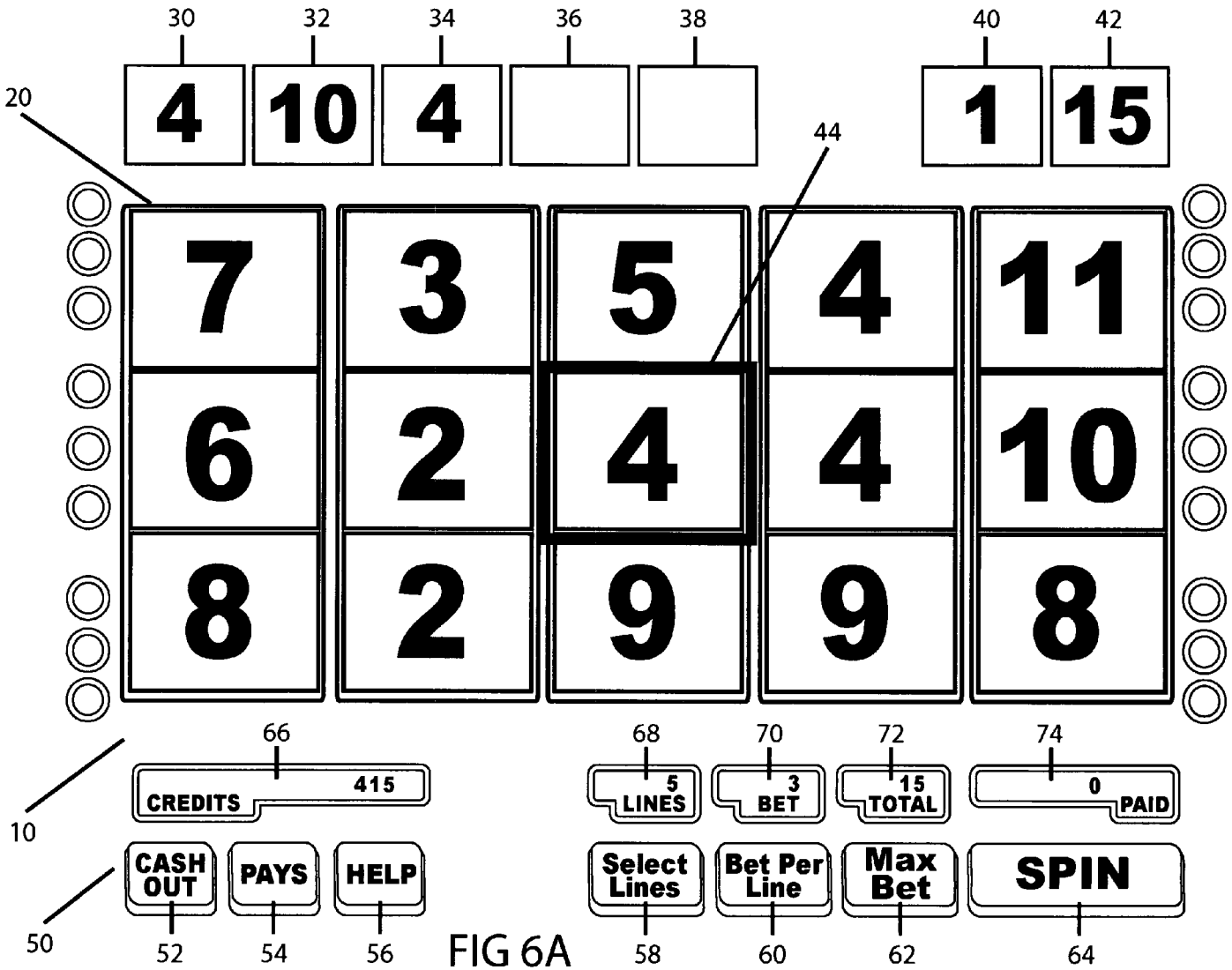
FIGS. 6*a–b* show an illustrative example of representative displays that may be encountered during a typical game in accordance with the principles of the present invention.

Again, Sam presses the Spin Reels button 64. The Credits meter 66 counts down from 430 to 415. The slot reels spin and stop. Using the numbers 1 to 15 to represent the symbol set, with 13 and 14 as the scatter symbols, and 15 as the wild symbol, the reels of the game display the following symbols, as shown in FIG. 6*a*:

| | | | | |
|---|---|---|---|---|
| 7 | 3 | 5 | 4 | 11 |
| 6 | 2 | [4] | 4 | 10 |
| 8 | 2 | 9 | 9 | 8 |

(Selected Symbol indicated by [brackets].)

Figure 6B:
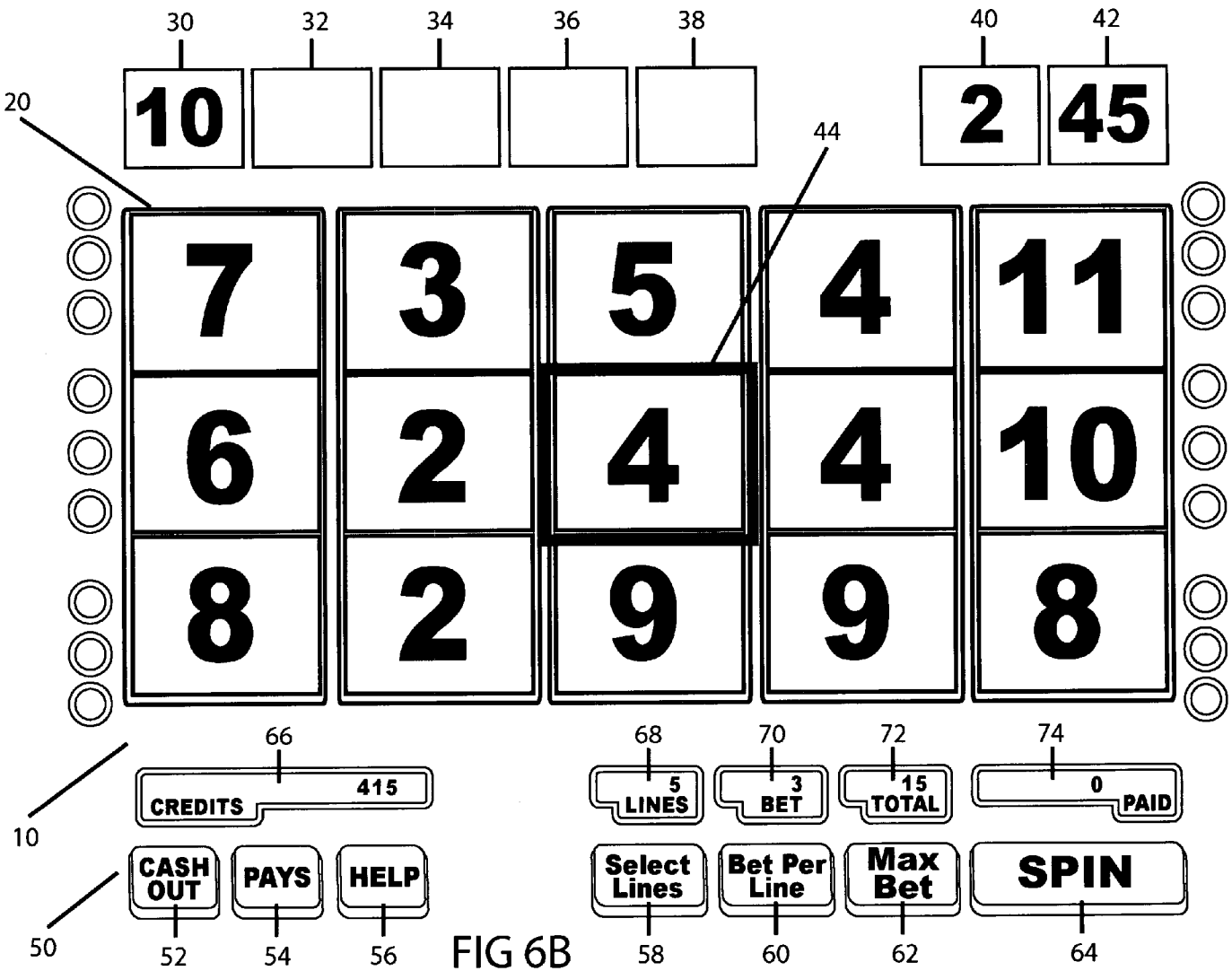

Since there is no winning line pay, the base game does not award any credits. The selected symbol "4" is copied from the symbol matrix position 3/2 (and highlighted by a black box) 44 into the third Pair'em Up window 34. The Pair'em Up windows 30–38 contain three symbols: 4-10-4. As shown in FIG. 6*b*, the two 4's form a match and the 4's disappear from the Pair'em Up window. And, the Pair'em Up window then contains one symbol: 10.

For the second match of the Pair'em Up game, the game awards 2 credits for every credit wagered, or 30 credits. The Number of Pairs meter 40 increases from 1 to 2 and the Pair Credits meter 42 increases from 15 to 45. Note that the Credits meter 66 stays at 415 and the Paid meter 74 reads 0.

Sam continues to play the slot game and collect line pays and select symbols. Over the course of the next 4 spins, Sam spends 60 credits to spin, collects 0 credits in line pays and selects the following symbols from the symbol matrix: 6-7-2-3. The Credits meter 66 reads 355, the Paid meter 74 reads 0, the Number of Pairs meter 40 reads 2, and the Pairs Credits 42 meter reads 45.

Figure 7A:
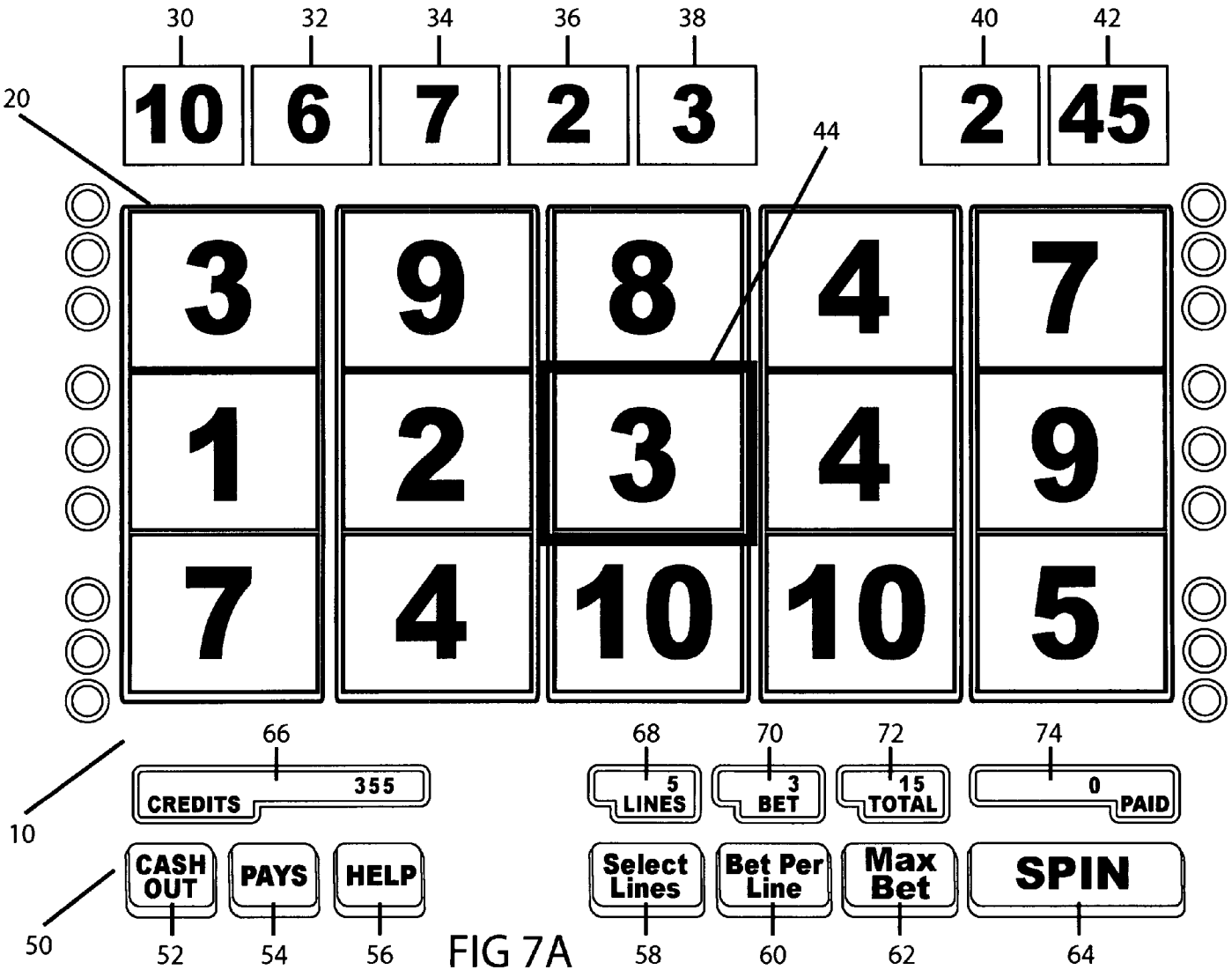
FIGS. 7*a–b* show an illustrative example of representative displays that may be encountered during a typical game in accordance with the principles of the present invention.
Figure 7B:
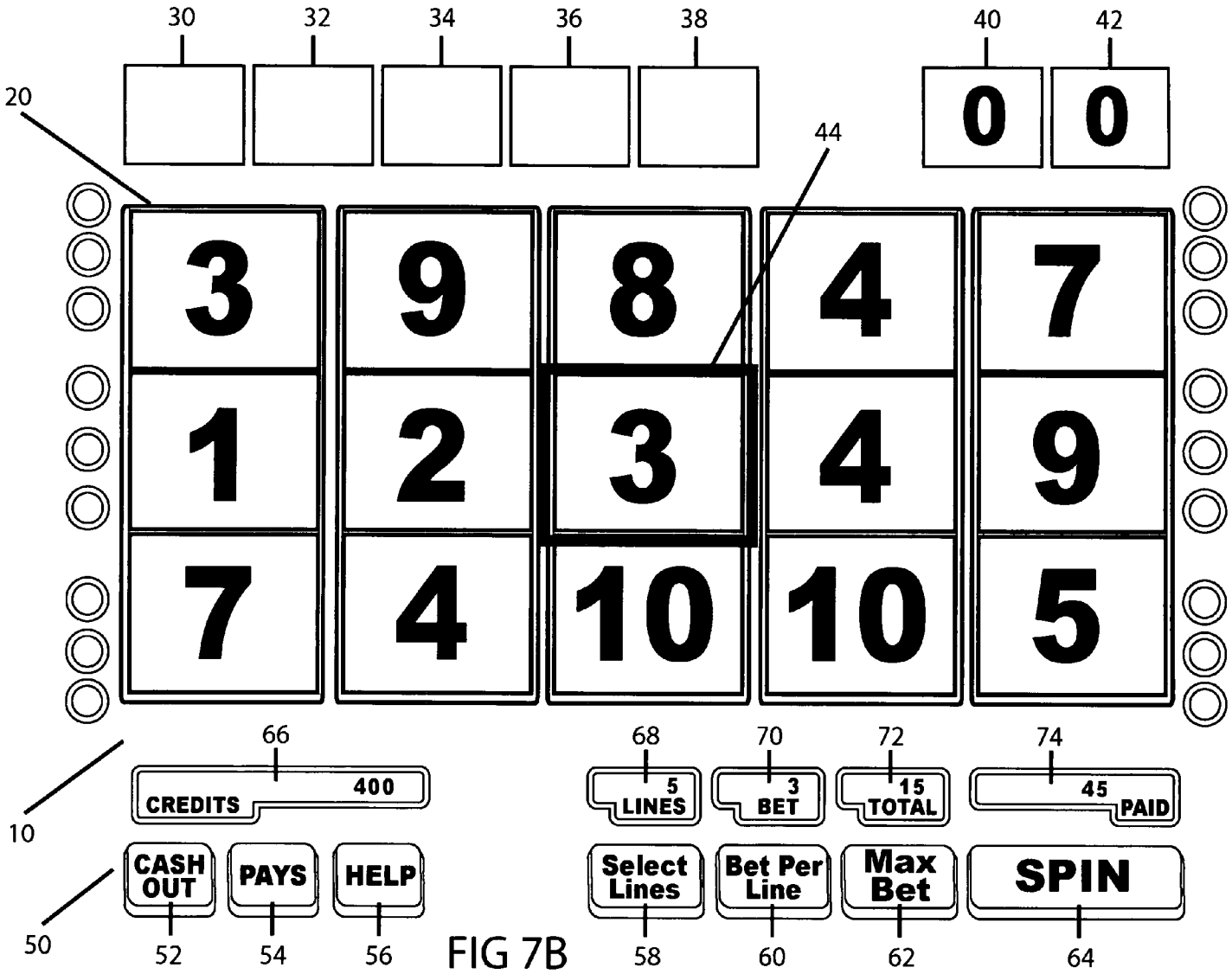

At the end of these spins, the Pair'em Up windows 30–38 display 5 non-matching symbols: 10-6-7-2-3, as shown in FIG. 7*a*. With all five Pairs windows full, the Pair'em Up game ends. As shown in FIG. 7*b*, the Pair'em Up windows 30–38 clear and Sam receives 45 credits from the Pair'em Up game. The Number of Pairs meter 40 counts from 2 to 0, Pairs Credits meter 42 counts from 45 to 0, the Paid meter 74 counts from 0 to 45, and Credits 66 meter counts from 355 to 400.

At the end of the Pair'em Up game, Sam may continue to play the base game and start a new Pair'em Up game. Content with his winnings, however, Sam presses the Cash Out button 52. The gaming device issues 400 nickels or any other form of standard currency, including cash, a standard EZ-PAY™ ticket, or standard electronic payment.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention. While the foregoing invention has been described in detail by way of illustration and example of preferred embodiments, numerous modifications, substitutions, and alterations are possible without departing from the scope of the invention defined in the following claims.

What is claimed is:

1. A method of playing a game having a display area including a symbol matrix optionally formed by a plurality of rows intersecting with a plurality of columns, with the plurality of rows and columns optionally defining a plurality of pay lines; the symbol matrix including a plurality of symbols, and the display area including a bonus area with a plurality of positions, comprising:

a) a player making a wager to participate in the game;

b) rearranging the plurality of symbols;

c) displaying the rearranged symbols;

d) selecting one or more symbols from the symbol matrix, wherein said selecting step (d) further includes at least one of the steps of:

selecting one or more symbols from the symbol matrix every N spins, wherein N is a fixed, positive integer;

selecting one or more symbols from the symbol matrix every N spins, wherein N is a variable, positive integer; and selecting one symbol from the symbol matrix every single spin;

e) displaying the selected symbol in the bonus area;

f) awarding the player based on at least one of the following winning combinations of symbols:

1) when two or more predetermined symbols appear contiguously or partially contiguously on at least one of the plurality of pay lines;

2) when two or more predetermined symbols appear anywhere in the symbol matrix; and 3) when one or more pre-determined symbols appear in the bonus area.

2. A method of claim 1 wherein one or more symbols is selected from one of: one or more fixed positions in the symbol matrix.

3. A method of claim 1(d) in which one or more symbols is selected from one or more variable positions in the symbol matrix.

4. A method of claim 1(d) in which one or more symbols is selected from the one or more positions indicated before and/or after the spin by the player.

5. A method of claim 1(d) in which one symbol is selected from the position located in middle row and middle column of a 5-column by 3-row symbol matrix.

6. A method of claim 1(d) in which any symbol may be selected.

7. A method of claim 1(d) in which only a sub-set of symbols may be selected.

8. A method of claim 1(e) in which selected symbols are copied from the symbol matrix and the copy displayed in the bonus area.

9. A method of claim 1(d) and (e) in which any number of symbols may be selected and displayed in the bonus area.

10. A method of claim 1(e) in which there are a limited number of positions in the bonus area.

11. A method of claim 1(e) in which there are a five positions in the bonus area.

12. A method of claim 1(d) and (e) in which symbols may only be selected if there is an empty position in the bonus area.

13. A method of claim 1(f)(3) in which symbols triggering awards are not removed from the bonus area.

14. A method of claim 1(f)(3) in which symbols triggering awards are removed from the bonus area.

15. A method of claim 1(f)(3) in which a pre-determined number of awards may be issued.

16. A method of claim 1(f)(3) in which any two same symbols trigger an award.

17. A method of claim 1(f)(3) in which awards are issued as they are triggered.

18. A method of claim 1(f)(3) in which awards are accumulated, the total value issued, and the bonus area cleared after a pre-determined event.

19. A method of claim 1(f)(3) in which awards are accumulated, the total value issued, and the bonus area cleared after every position in the bonus area is filled.

20. A method of claim 1(f)(3) in which awards are accumulated, the total value issued, and the bonus area cleared after a pre-determined number of awards are issued.

21. A method of claim 1(f)(3) in which awards are accumulated, the total value issued, and the bonus area cleared after a player's indication to issue some or all of the total value.

22. A method of playing a game having a display area including a symbol matrix optionally formed by a plurality of rows intersecting with a plurality of columns, with the plurality of rows and columns optionally defining a plurality of pay lines; the symbol matrix including a plurality of symbols, and the display area including a bonus area with a plurality of positions, comprising:

a) a player making a wager to participate in the game;

b) rearranging the plurality of symbols;

c) displaying the rearranged symbols;

d) selecting one or more symbols from the symbol matrix;

e) displaying the selected symbol in the bonus area, wherein selected symbols are removed from the symbol matrix and the original displayed in the bonus area;

f) awarding the layer based on at least one of the following winning combinations of symbols:

1) when two or more predetermined symbols appear contiguously or partially contiguously on at least one of the plurality of pay lines;

2) when two or more predetermined symbols appear anywhere in the symbol matrix; and more pre-determined symbols appear in the bonus.

23. A method of playing a game using a symbol matrix formed by a plurality of rows intersecting with a plurality of columns, with the plurality of rows and columns optionally defining a plurality of pay lines and including a plurality of symbols, and a bonus area, with five positions, comprising:

a) a player making a wager to participate in the game;

b) randomly rearranging the plurality of symbols;

c) displaying the rearranged symbols;

d) selecting any symbol displayed in a fixed position in the symbol matrix at the end of every spin, wherein said selecting step (d) further includes at least one of the steps of:

selecting one or more symbols from the symbol matrix every N spins, wherein N is a fixed, positive integer;

selecting one or more symbols from the symbol matrix every N spins, wherein N is a variable, positive integer; and selecting one symbol from the symbol matrix every single spin;

e) copying the selected symbol and displaying the copy in an empty position in the bonus area;

f) awarding the player based on at least one of the following winning combinations of symbols:

1) when two or more predetermined symbols appear contiguously or partially contiguously on at least one of the plurality of pay lines;

2) when two or more predetermined symbols appear anywhere in the symbol matrix; and 3) when any two same selected symbols appear in the bonus area;

g) removing symbols triggering awards from the bonus area; and h) issuing the accumulated value of awards for selected symbols and clearing the bonus area based upon at least one of the following events:

1) filling all five positions in the bonus area without forming a winning combination;

2) awarding all of the pre-determined number of awards for winning combinations of selected symbols; and 3) a player's indication to award some or all o the accumulated value.

24. A method according to claim 23, wherein the predetermined criteria comprises a substantial match of symbols, and wherein said awarding step i) further comprises the step of awarding the player when the at least one of the plurality of symbols and the at least another of the plurality of symbols substantially match one another.

25. A method of playing a game using a symbol matrix formed by a plurality of rows intersecting with a plurality of columns, with the plurality of rows and columns optionally defining a plurality of pay lines and including a plurality of symbols, and a bonus area having a predetermined number of positions, comprising the steps of:

a) rearranging the plurality of symbols as a first symbol arrangement;

b) displaying the first symbol arrangement;

c) selecting at least one of the plurality of symbols from the first symbol arrangement;

d) displaying the at least one of the plurality of symbols selected in at least one of the predetermined positions in the bonus area;

e) rearranging the plurality of symbols as a second symbol arrangement;

f) displaying the second symbol arrangement;

g) selecting at least another of the plurality of symbols from the second symbol arrangement;

h) displaying the at least another of the plurality of symbols selected in at least another of the predetermined positions in the bonus area, wherein selected symbols are removed from the symbol matrix and the original displayed in the bonus area;

i) awarding the player when the at least one of the plurality of symbols and the at least another of the plurality of symbols satisfy predetermined criteria;

j) issuing an accumulated value of awards to the player and clearing the bonus area based upon at least one of the following events:

1) filling all of the predetermined positions in the bonus area without forming a winning combination;

2) awarding all predetermined number of awards for winning combinations of selected symbols; and 3) a player's indication to award at least some of the accumulated value.

26. A method of playing a game having a display area including a symbol matrix optionally formed by a plurality of rows intersecting with a plurality of columns, with the plurality of rows and columns optionally defining a plurality of pay lines; the symbol matrix including a plurality of symbols, and the display area including a bonus area with a plurality of positions, comprising:

a) a player making a wager to participate in the game;

b) rearranging the plurality of symbols;

c) displaying the rearranged symbols;

d) selecting one or more symbols from the symbol matrix, wherein said selecting step;

d) further includes at least one of the steps of:

selecting one or more symbols from the symbol matrix every N spins, wherein N is a fixed, positive integer;

selecting one or more symbols from the symbol matrix every N spins, wherein N is a variable, positive integer; and selecting one symbol from the symbol matrix every single spin;

e) displaying the selected symbol in the bonus area;

f) awarding the player based on said selecting step (d).

* * * * *